US007193595B2

(12) United States Patent
Lee et al.

(10) Patent No.: US 7,193,595 B2
(45) Date of Patent: Mar. 20, 2007

(54) LIQUID CRYSTAL DISPLAY

(75) Inventors: Jun-Pyo Lee, Kyungki-do (KR); Young-Gil Kim, Kyungki-do (KR); Hoi-Sik Moon, Kyungki-do (KR); Hyun-Su Lee, Kyungsangbuk-do (KR); Byoung-Jun Lee, Seoul (KR)

(73) Assignee: Samsung Electronics, Co., Ltd., Gyeonggi-do (KR)

( * ) Notice: Subject to any disclaimer, the term of this patent is extended or adjusted under 35 U.S.C. 154(b) by 409 days.

(21) Appl. No.: 10/482,241

(22) PCT Filed: Jun. 18, 2002

(86) PCT No.: PCT/KR02/01153

§ 371 (c)(1),
(2), (4) Date: Dec. 18, 2003

(87) PCT Pub. No.: WO02/103437

PCT Pub. Date: Dec. 27, 2002

(65) Prior Publication Data

US 2004/0169629 A1 Sep. 2, 2004

(30) Foreign Application Priority Data

Jun. 18, 2001 (KR) ..... 2001-034367

(51) Int. Cl.
*G09G 3/36* (2006.01)

(52) U.S. Cl. ..... 345/89

(58) Field of Classification Search ..... 345/87–89, 345/95, 204

See application file for complete search history.

(56) References Cited

U.S. PATENT DOCUMENTS 5,754,150 A * 5/1998 Matsui ..... 345/89

FOREIGN PATENT DOCUMENTS

JP 2000134507 A * 5/2000

OTHER PUBLICATIONS

PCT International Search Report dated Mar. 26, 2003 corresponding to PCT/KR 02/01153.
PCT International Preliminary Examination Report dated Oct. 22, 2003 corresponding to PCT/KR02/01153.

* cited by examiner

*Primary Examiner*—Amr A. Awad
*Assistant Examiner*—Stephen Sherman
(74) *Attorney, Agent, or Firm*—MacPherson Kwok Chen & Held LLP

(57) ABSTRACT

A gamma voltage generator of a liquid crystal display (LCD) capable of removing residual images by compensating a gamma voltage. The gamma voltage generation apparatus adjusts the common voltage by the kickback voltage for the intermediate gray level, and tunes the gamma voltages other than the intermediate gray level gamma voltage. The adjustment of the gamma voltages other than the intermediate gray level gamma voltage is achieved in such a manner that the difference between the intermediate gray level kickback voltage and the kickback voltage at one of the gray levels other than the intermediate gray level is equal to half of the difference between the sum of the two inverted gamma voltages representing the intermediate gray level gamma voltages and the sum of the two inverted gamma voltages corresponding to the selected gray level.

2 Claims, 5 Drawing Sheets

LIQUID CRYSTAL DISPLAY

CROSS-REFERENCE TO RELATED APPLICATION

This application is a national phase application of PCT/KR02/01153 filed on Jun. 18, 2002, and claims priority thereto under 35 USC 371. PCT/KR02/01153, in turn, claims priority from Korean Application No. 2001/34367 filed on Jun. 18, 2001, the content of which is incorporated by reference herein in its entirety.

BACKGROUND OF THE INVENTION (a) Field of the Invention

The present invention relates to a liquid crystal display, and in particular, to a gamma voltage generator of a liquid crystal display (LCD) that is capable of removing a residual image by compensating a gamma voltage.

(b) Description of the Related Art

Typically, a liquid crystal display uses a thin film transistor as a switching element for applying an analog gray voltage to a pixel so as to display an image. The number of the gray voltages is limited to 64 or 256 according to the types of digital analog converter (DAC) provided in a source driver. The DAC produces 64 or 256 gray voltages by selectively switching 6-bit or 8-bit red (R), green (G), and blue (B) digital data from an external source, and supplies the gray voltages to the pixels via data lines in an LCD panel assembly.

FIG. 1 is an equivalent circuit diagram of a typical pixel; and FIG. 2 is a graph showing typical waveforms of a gate voltage, a data voltage, and a pixel voltage.

A gray voltage generated by a DAC for supply to a data line is expressed as a data voltage Vdata in FIG. 1 and FIG. 2. The data voltage Vdata becomes a pixel voltage Vp after passing through a TFT which is turned on by a high state VgH of a gate voltage Vg. The voltage difference between the pixel voltage Vp and a common voltage Vcom applied to a liquid crystal capacitor Clc determines the transmittance of light. Since the common voltage Vcom has a fixed value or swings between two fixed values, the pixel voltage Vp substantially determines the light transmittance.

Under the high value VgH of the gate voltage Vg of the TFT, the pixel voltage Vp reaches the data voltage Vdata. The pixel voltage Vp drops by as much as a kickback voltage Vk due to parasitic capacitors (Cg, Cgd) after the gate voltage Vg becomes low VgL.

The kickback voltage Vk is determined by the following equation:

$$Vk = \frac{(Vcom - Vp)(Clcon - Clcoff) + \Delta VgCgd + (VgH - Vp)Cg/2}{Cgd + Clcoff + Cst},$$

where Clcon is the capacitance of a charged liquid crystal capacitor when the pixel is charged, Clcoff is the capacitance of a completely discharged liquid crystal capacitor, Cg is a parasitic capacitance between a channel and a gate of the TFT, and Cgd is a parasitic capacitance between the gate and a drain of the TFT.

As shown by the equation, the kickback voltage Vk varies significantly depending on the voltage difference between the pixel voltage Vp and the common voltage Vcom, as shown in FIG. 4, as well as depending on the pixel voltage Vp itself. It is because the capacitance of the liquid crystal capacitor Clc depends on the voltage across the liquid crystal capacitor Clc due to the dielectric anisotropy of liquid crystal. FIG. 3 shows the dielectric constant which increase as the magnitude of the bias voltage across the liquid crystal capacitor Clc. Therefore, it is hard to compensate the kickback voltage Vk using the gray voltages.

To prevent the typical distortion of the pixel voltage Vp due to the kickback voltage Vk, it is suggested that the intermediate grays where the pixel voltages Vp are about 1.8V are compensated by adjusting the common voltage Vcom, although the white and the black grays are not completely compensated. However, when an image including black and white grays is displayed for a long time, and thus a DC bias voltage having a value as much as the difference between the kickback voltage Vk and the intermediate gray voltage is applied for a long time, this causes a defect in the LCD panel assembly referred to as image sticking.

SUMMARY OF THE INVENTION

The present invention has been made in an effort to solve the above problems of the prior art.

It is an object of the present invention to provide an LCD capable of minimizing residual images by removing a residual DC bias caused by a kickback voltage.

To achieve the above object, the present invention provides a liquid crystal display (LCD) for displaying images with a gray voltage generated by a source driver using a gamma voltage supplied from a printed circuit board. The LCD comprises gamma voltage generation unit generating a common voltage control signal for adjusting a common voltage by as much as a kickback voltage at an intermediate gray level when a predetermined kickback voltage associated with a presently displayed image is inputted by a user utilizing a predetermined process, randomly selecting a gamma voltage at a gray level other than the intermediate gray level, and adjusting the selected gamma voltage; and a common voltage generator for adjusting the common voltage by as much as the kickback voltage at the intermediate gray level on the basis of the common voltage control signal, and outputting the adjusted common voltage to an LCD panel. The gamma voltage generation unit satisfies the following equation:

$$|Vkc - Vkt| = |(VGMAUP(C) + VGMADN(C)/2 - (VGMAUP(t) + VGMADN(t))/2|$$

where Vck is a kickback voltage at the intermediate gray level, Vkt is the kickback voltage at the selected gray level, VGMAUP(C) and VGMADN(C) are gamma voltages inverted at the intermediate gray level, and VGMAUP(t) and VGMADN(t) are the gamma voltages inverted at the selected gray level.

Accordingly, if a predetermined kickback voltage associated with a presently displayed image is inputted by the user, the gamma voltage generation apparatus adjusts the common voltage by as much as the kickback voltage at the intermediate gray level and tunes the gamma voltages other than the gamma voltage at the intermediate gray level to tune the distorted pixel voltage at the gray levels other than the intermediate gray level. Here, the adjustment of the gamma voltages other than the intermediate gray level gamma voltage is achieved in such a manner that the difference between the intermediate gray level kickback voltage and the kickback voltage at one of the gray levels other than the intermediate gray level is equal to half of the difference between the sum of the two inverted gamma voltages representing the intermediate gray level gamma voltages and the sum of the two inverted gamma voltages corresponding to the selected gray level. Therefore, the generation of residual images is minimized in the displayed image.

To achieve the above object, a method for driving a liquid crystal display (LCD) which displays images with a gray voltage generated by a source driver using a gamma voltage supplied from a gamma voltage generator comprises the steps of: (a) generating a common voltage control signal for adjusting a common voltage by as much as a kickback voltage at an intermediate gray level when a predetermined kickback voltage associated with a presently displayed image is inputted by a user utilizing a predetermined process; and (b) randomly selecting a gamma voltage at a gray levels other than the intermediate gray level, and adjusting the selected gamma voltage. The gamma voltage adjustment in step (b) satisfies the following equation:

$$|Vkc-Vkt|=|(VGMAUP(C)+VGMADN(C)/2-(VGMAUP(t)+VGMADN(t))/2|$$

where Vck is a kickback voltage at the intermediate gray level, Vkt is the kickback voltage at the selected gray level, VGMAUP(C) and VGMADN(C) are gamma voltages inverted at the intermediate gray level, and VGMAUP(t) and VGMADN(t) are the gamma voltages inverted at the selected gray level.

BRIEF DESCRIPTION OF THE DRAWINGS

The above and other objects and advantages of the present invention will become more apparent by describing preferred embodiments thereof in detail with reference to the accompanying drawings in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout. Then, liquid crystal displays according to embodiments of the present invention will be described with reference to the drawings.

Figure 1:
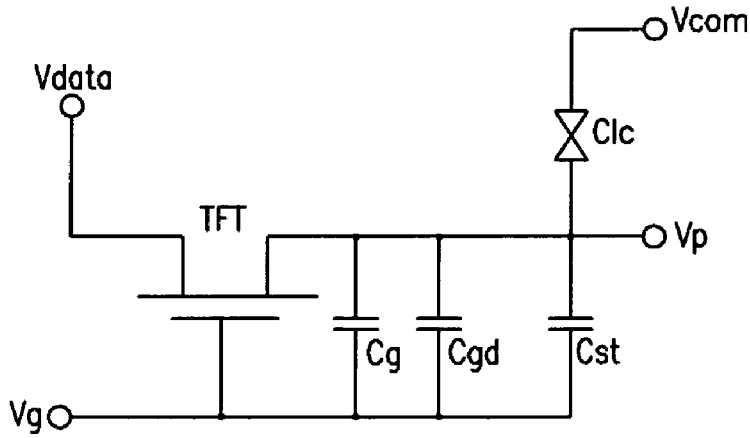
FIG.1(Prior Art)
FIG. 1 is an equivalent circuit diagram of a typical pixel.
Figure 2:
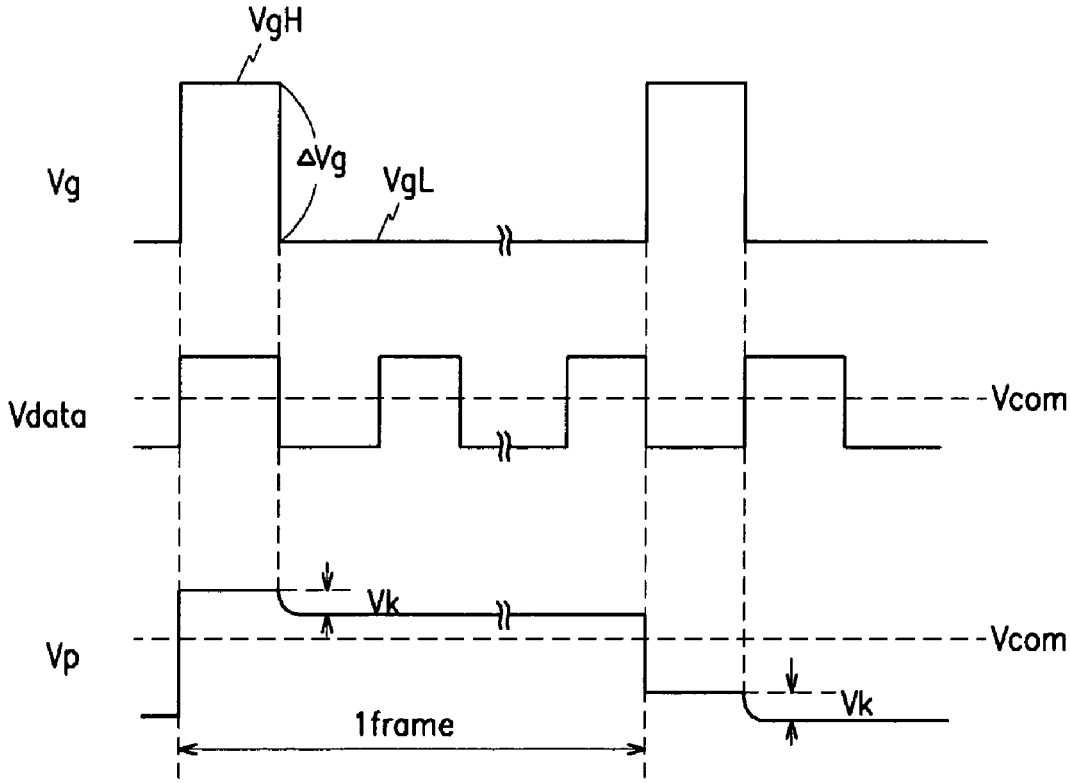
FIG.2(Prior Art)
FIG. 2 is a graph illustrating typical waveforms of a gate voltage, a data voltage, and a pixel voltage.
Figure 3:
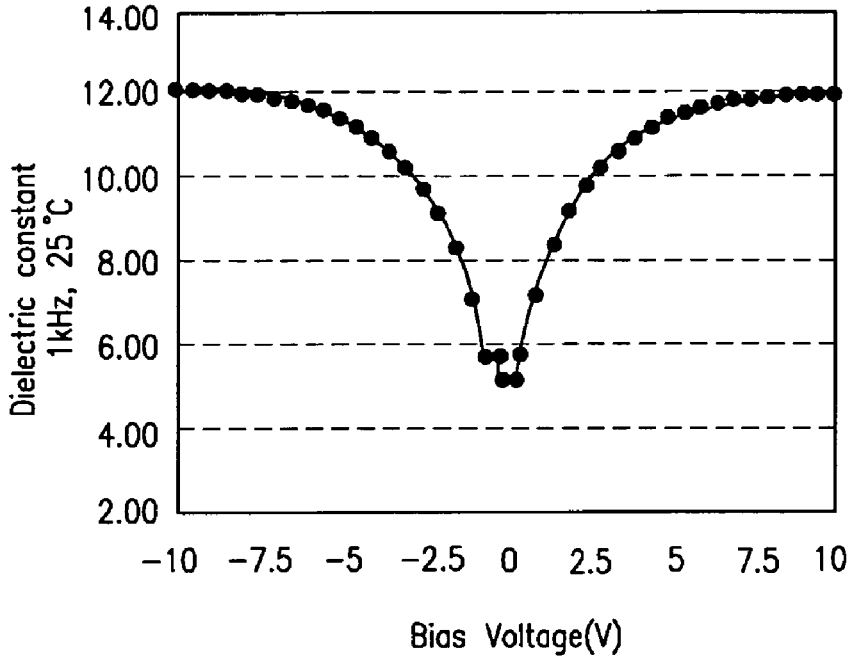
FIG.3(Prior Art)
FIG. 3 is a graph for illustrating a dielectric constant of a typical liquid crystal as function of bias voltage.
Figure 4:
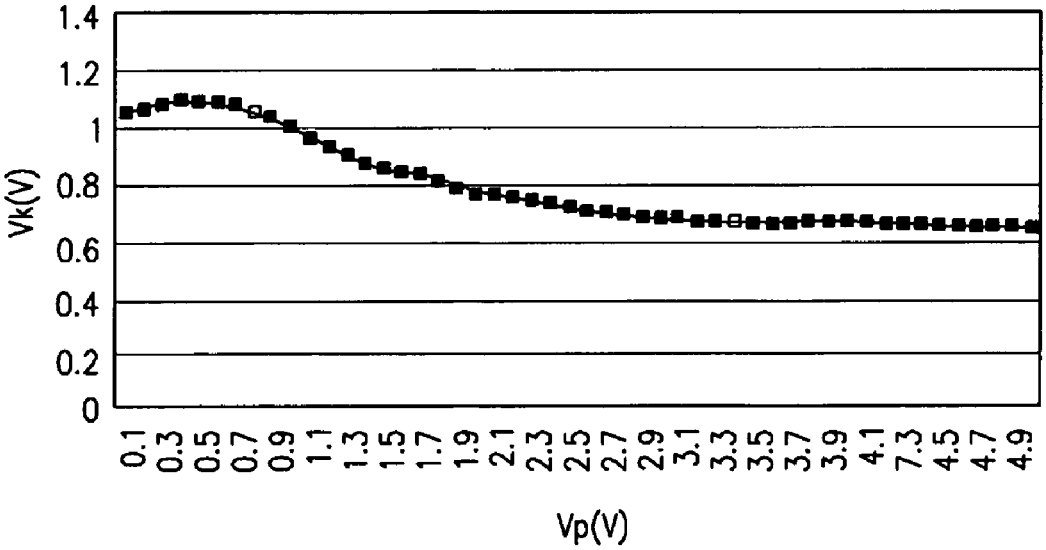
FIG.4(Prior Art)
FIG. 4 is a graph illustrating a typical kickback voltage as function of the pixel voltage.
Figure 5:
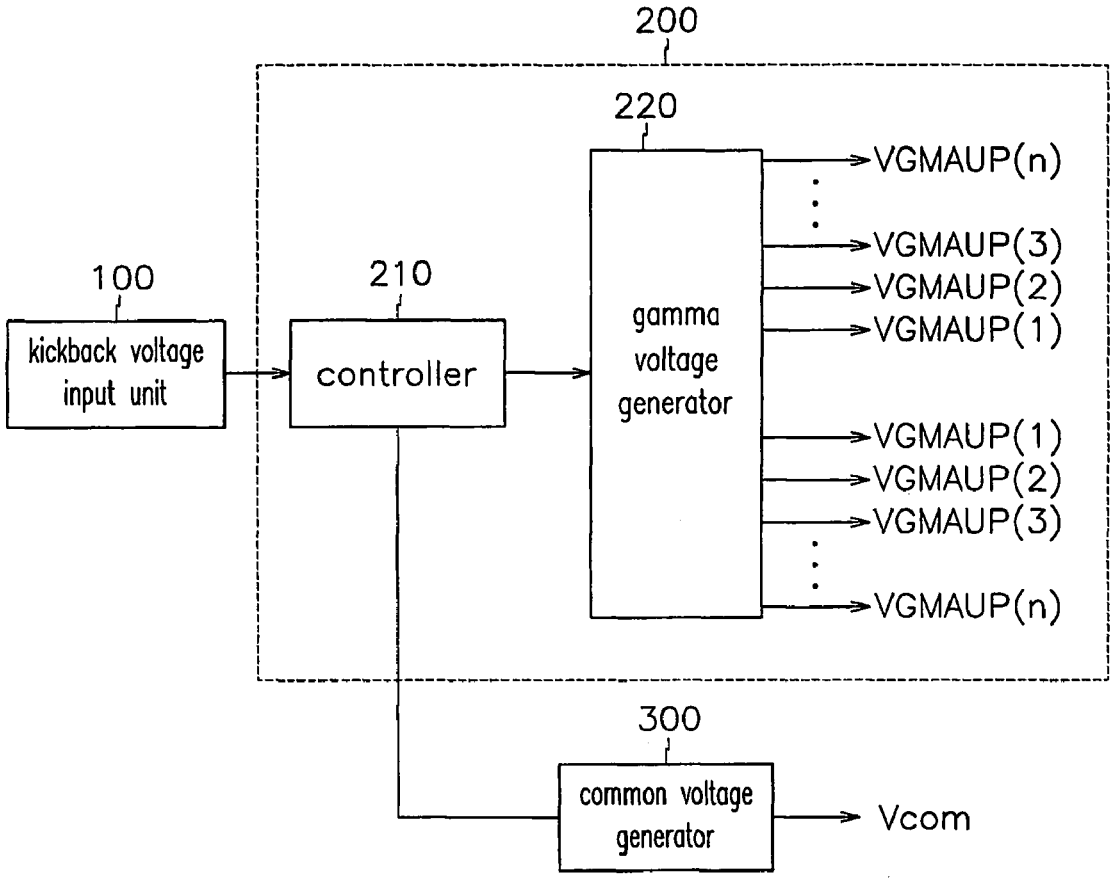
FIG. 5 is a block diagram illustrating a gamma voltage compensation apparatus according to a preferred embodiment of the present invention.

FIG. 5 is a block diagram illustrating a gamma voltage compensation apparatus according to an embodiment of the present invention.

As shown in FIG. 5, a gamma voltage compensation apparatus for an LCD according to the preferred embodiment of the present invention includes a kickback voltage input unit 100, a gamma voltage generation unit 200, and a common voltage generator 300.

The kickback voltage input unit 100 is a button mounted on a PCB module or a LCD case that triggers the supply of an input kickback voltage Vk generated depending on an LCD panel assembly. Alternatively, the kickback voltage Vk can be recognized by a controller, which will be described below, using an application program. The kickback voltage Vk from the kickback voltage input unit 100 is represented by Vk0, Vk1, Vk2, . . . , Vkm for the respective gray levels of 0, 1, 2, . . . , and a maximum gray level.

The gamma voltage geneeration unit 200 includes a controller 210 and a gamma voltage generator 220.

The controller 210 generates a common voltage control signal for adjusting the value of a common voltage by as much as the kickback voltage Vk in intermediate grays, and generates a gamma voltage control signal for adjusting gamma voltages. By randomly selecting gamma voltages at all gray levels except the intermediate gray level for tuning a distorted pixel voltage in all gray levels except the intermediate gray level so as to satisfy the following equation.

$$|Vkc-Vkt|=|(VGMAUP(C)+VGMADN(C)/2-(VGMAUP(t)+VGMADN(t))/2|$$

where Vkc is a kickback voltage in an intermediate grey level, Vkt is a selected kickback voltage in a selected gray level, VGMAUP(C) and VGMADN(C) are gamma volategs inverted in the intermediate gray level, and VGMAUP(t) and VGMADN(t) are gamma voltage in a selected gray level.

Figure 6:
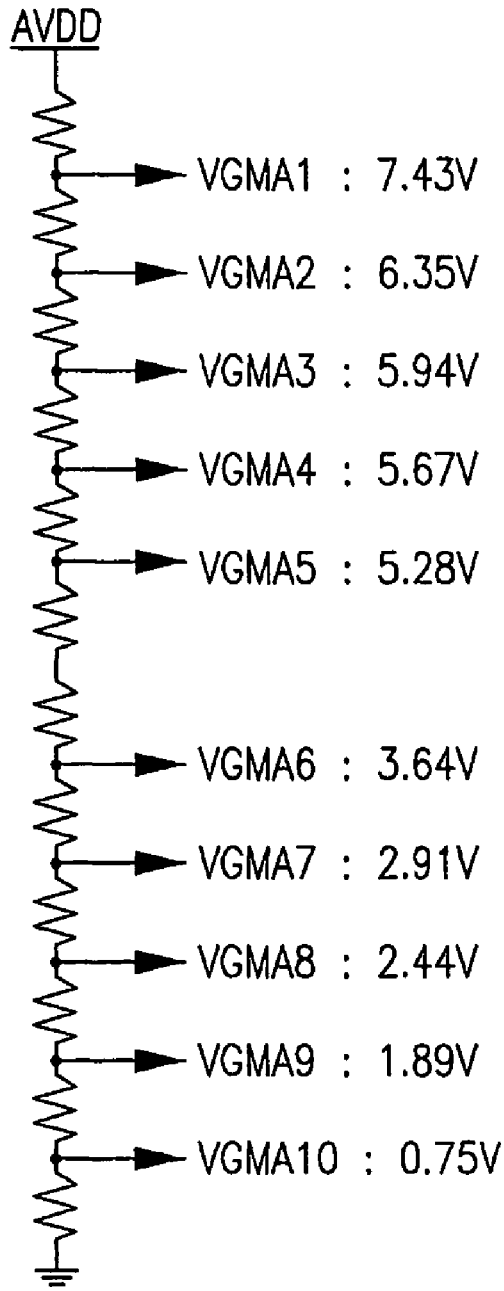
FIG. 6 is drawing for illustrating a gamma voltage outputted from a gamma voltage output part of the gamma voltage compensation apparatus of FIG. 5.

The gamma voltage generator 220 generates gamma voltages on the basis of the gamma voltage control signal from the controller 210. The gamma voltages are generated by dividing a voltage using a series of resistors as shown in FIG. 6. The gamma voltages generated by the gamma voltage generator 220 include two groups of gamma voltages having the same number of gamma voltages, i.e., a high group of gamma voltages including VGMAUP(1), VGMAUP(2), VGMAUP(3), . . . , and VGMAUP(n) that are than the common voltage Vcom, and a low group of gamma voltages including VGMADN(1), VGMADN(2), VGMADN(3), . . . , VGMADN(n) lower than the common voltage Vcom.

A number (n) of the gamma voltages may vary depending on the bit number of digital input from the DAC in the source driver and depending on the specifications used by the manufacturer. In the case where the digital input is 6 bits, each of the high and low groups requires 5 gamma voltages.

The common voltage generator 300 generates the common voltage Vcom modified by as much as the kickback voltage Vk of the intermediate grays based on the common voltage control signal, and provides the common voltage for the LCD panel assembly.

An operation of the gamma voltage compensation apparatus for the LCD according to the preferred embodiment of the present invention will be described in more detail hereinafter.

As shown in FIG. 6, a typical gamma voltage generator 220 includes a plurality of a series of resistors between a power source (AVDD) and a ground. The gamma voltages VGMA1~VGMA10 are supplied to the source driver connected to data lines of the LCD panel assembly. An example in which each the high and low groups has five gamma voltages for supply to a 6-bit DAC will be explained. The gamma voltages, VGMA1~VGMA10, are generally set to be supplied at uniform levels so as to fit the specifications of the source driver. In the present invention, the gamma voltages are reset for removing the residual images caused by a residual DC resulting from pixel voltage distortion.

Among the distributed gamma voltages, the five gamma voltages VGMA1~VGMA5 belonging to the high group are of generating voltages higher than the common voltage Vcom and are respectively identical to the voltages VGMAUP(5)~VGMAUP(1), and the five gamma voltages VGMA6~VGMA10 belonging to the low group are of generating voltages lower than the common voltage Vcom and are respectively identical with the voltages VGMADB(1)~VGMA(5), as shown in table 1. That is, in the case where the displayed image is normally white, the gamma voltages VGMA5 and VGAM6 are maximum gray level (white) gamma voltages, the gamma voltages VGMA1 and VGMA10 are minimum gray level (black) gamma voltages, and the gamma voltages VGMA3 and VGMA8 are intermediate gray level gamma voltages.

Figure 7:
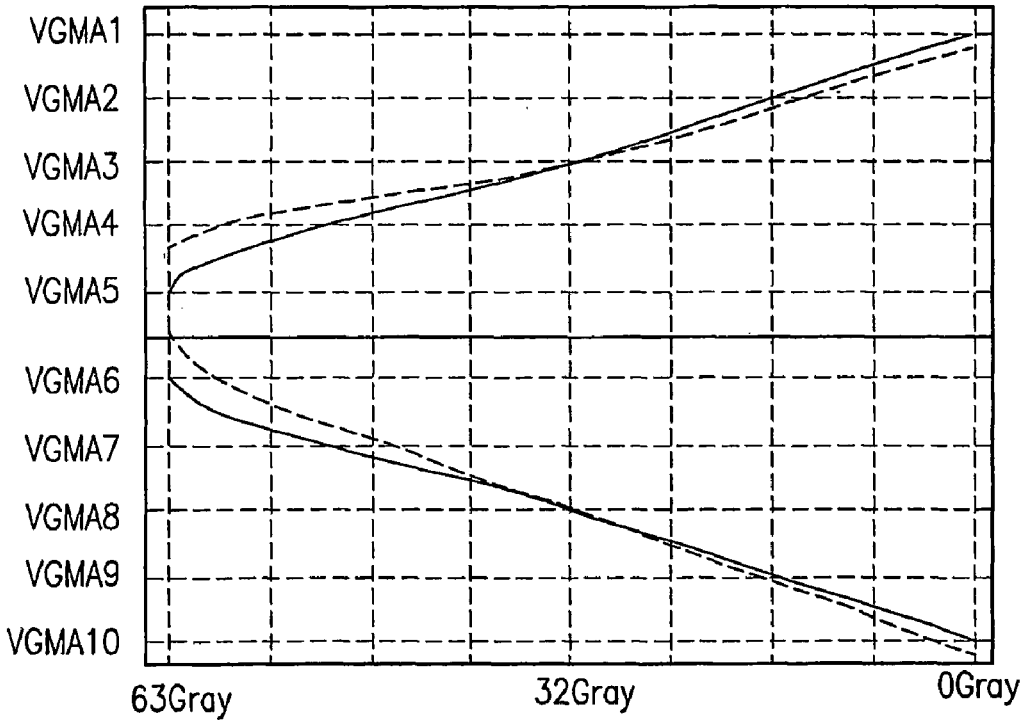
FIG. 7 is a graph for illustrating gamma voltages before and after gamma voltage compensation, in which the gamma voltages are shown relative to a gray voltage.

FIG. 7 is a graph for illustrating gamma voltages before and after gamma voltage compensation, in which the gamma voltages are shown relative to gray levels provided to a DAC processing 6 bits. The gray levels to 10 gamma voltages are expressed when inversely operated in the preferred embodiment of the present invention. The solid line shows the display characteristics of an LCD panel during operation, and the dotted line shows gamma characteristics obtained by removing the residual DC using the common voltage (Vc) and the gamma voltage by compensating the flicker, i.e., the pixel voltage distortion (kickback voltage).

TABLE 1

| | Gamma voltage before compensation | Gamma voltage after compensation |
|---|---|---|
| VGMA1(VGMAUP5) | 7.32 V | 7.43 V |
| VGMA2(VGMAUP4) | 6.38 V | 6.35 V |
| VGMA3(VGMAUP3) | 5.94 V | 5.94 V |
| VGMA4(VGMAUP2) | 5.62 V | 5.67 V |
| VGMA5(VGMAUP1) | 5.14 V | 5.28 V |
| VGMA6(VGMADN1) | 3.48 V | 3.64 V |
| VGMA7(VGMADN2) | 2.86 V | 2.91 V |
| VGMA8(VGMADN3) | 2.44 V | 2.44 V |
| VGMA9(VGMADN4) | 1.88 V | 1.89 V |
| VGMA10(VGMADN5) | 0.64 V | 0.75 V |

To remove the residual images caused by the residual DC, it is required to determine the kickback voltage Vk, which varies according to the bias voltage across the LCD. The kickback voltage Vk can be determined through a SPICE simulation or through measurements. However, the kickback voltage Vk is non-linear due to the characteristics of liquid crystal, a dielectric of which varies according to the pixel voltage. Therefore, it is not preferred to compensate the kickback voltage only using the common voltage Vcom because in the case of using only the common voltage, kickback voltage compensation is achieved at only one side of the gray levels while the kickback voltage is deteriorated at the other side of the gray levels, relative to the intermediate gray level. Accordingly, it is preferable to differently adjust the gamma voltage according to the pixel voltage (gray level).

For example, when the gamma voltage provided to the LCD panel during operation is identical to the gamma voltage before compensation in Table 1, the 10 inverted gamma voltages supplied to the source driver are expressed by the solid lines in FIG. 7. At this time, the kickback voltage Vk determined as described above is 0.65V at the minimum gray level Vk0, 00.75V at the intermediate gray level Vkc, and 1.02 at the maximum gray level Vkm. As described above, the kickback voltage Vk can be inputted by the operator using a tuner mounted on the PCB module, by an input key provided on the case of the LCD, or the kickback voltage Vk may be automatically recognized by the controller 210 using an application program.

First, at the intermediate gray levels (gray level=31) ante-compensation gamma voltages VGMA3 (VGMAUP(C)) and VGMADN(C) are 5.94V and 2.44V, respectively, and the kickback voltage (Vkc) is 0.75V such that the controller 210 generates the common voltage control signal for adjusting the common voltage by as much as the kickback voltage at the intermediate gray level, which can be expressed as the kickback voltage (0.75V) at the intermediate gray level=the common voltage tuning amount (0.75V).

In this manner, the common voltage decreases by as much as 0.75V, the gamma voltage VGMA3(VGMAUP(C) is maintained at 5.94V at the intermediate gray levels, and the gamma voltage VGMA8(VGMADN(C) is maintained at 2.44V at the intermediate gray levels.

Next, to tune the distorted pixel voltage at gray levels other than the intermediate gray levels, the controller 210 randomly selects a gamma voltage at these other gray levels so as to generate a gamma voltage control signal for tuning the corresponding gamma voltage. That is, the difference between the kickback voltage (Vkc) at the intermediate gray level and the kickback voltage (Vkt) selected among gray levels other than the intermediate gray levels becomes identical to half of the difference between the sum of the two inverted gamma voltages (VGMAUP(C), VGMADN(C)) and the sum of two inverted gamma voltages (VGMAUP(t), VGMADN(t)) corresponding to the randomly selected gray levels. This can be expressed as in the following equation.

$$|Vkc-Vkt|=(VGMAUP(C)+VGMADN(C)/2-(VGMAUP(t)+VGMADN(t)/2|$$

where Vkc is the kickback voltage at the intermediate gray level, Vkt is the kickback voltage at the selected gray level, VGMAUP(C) and VGMADN(C) are the gamma voltages inverted at the intermediate gray levels, and VGMAUP(t) and VGMADN(t) are the gamma voltages inverted at the selected gray levels.

In the above example, to tune the gamma voltages VGMA5(VGMAUP(1)) and VGMA6(VGMADN(1)) at the maximum gray level, the controller 210 performs control such that the difference (0.27V) between the kick voltage (Vkc=0.75) at the intermediate gray level and the kickback voltage (Vkm=1.02) at the maximum gray level become equal to half of the difference (0.54V) between the sum (8.38V) of the inverted gamma voltages (VGMA3=5.94 and VGMA8=2.44V) representing the two intermediate gray level gamma voltages and sum (8.92V) of the two inverted gamma voltages (VGMA5=5.28V and VGMA6=3.64V) representing the maximum gray level gamma voltages. Also, to tune the distorted pixel voltage, the controller 210 generates the gamma voltage control signal for tuning the maximum gray level gamma voltage by as much as 0.27V such that the gamma voltage generator 220 is set to output the tuned voltage. In this case, since the distorted voltage at the maximum gray level is larger than that at the minimum gray level, the gamma voltage is tuned so as to be high by as much as 0.27V as shown in FIG. 6 and FIG. 7. This can be expressed as follows.

$$|0.75V-1.02V|=|(5.94V+2.44V)/2-(5.28V+3.64V)/2|=0.27$$

In this manner, the data voltage Vdata is compensated so as to be higher than the kickback voltage (1.02V) at the maximum gray level by as much as 0.27V such that the pixel voltage distortion amount at the maximum gray level becomes 0.75V, which is equal to the distortion amount at the intermediate gray level. Here, since the common voltage Vcom is compensated so as to be low by as much as 0.75V, the distortion of the pixel voltage is removed.

Similarly, to tune the gamma voltages VGMA1(VGMAUP(5)) and VGMA10(VGMADN(5)) at the minimum gray level, the controller 210 performs controls such that the difference (0.1V) between the kickback voltage (Vkc=0.75) at the intermediate gray level and the kickback voltage (Vk0=0.65) at the minimum gray level become equal to half of the difference (0.2V) between the sum (8.38V) of the inverted gamma voltages (VGMA3=5.94 and VGMA8=2.44V) representing the two intermediate gray level gamma voltages and sum (8.18V) of the two inverted gamma voltages (VGMA1=7.43V and VGMA10=0.75V) representing the minimum gray level gamma voltages. Also, to tune the distorted pixel voltage, the controller 210 generates the gamma voltage control signal for tuning the minimum gray level gamma voltage by as much as 0.1V such that the gamma voltage generator 220 is set to output the tuned voltage. In this case, since the distorted voltage at the minimum gray level is smaller than that at the maximum gray level, the gamma voltage is tuned so as to be low by as much as 0.1V as shown in FIG. 6 and FIG. 7. This can be expressed as follows.

$$|0.75V-0.652V|=|(5.94V+2.44V)/2-(7.43V+0.75V)/2|=0.1$$

In this manner, the data voltage Vdata is compensated so as to be lower than the kickback voltage (Vk0=0.65) at the minimum gray level by as much as 0.1V such that the pixel voltage distortion amount at the minimum gray level becomes 0.75V, which is equal to the distortion amount at the intermediate gray level. Here, since the common voltage Vcom is compensated so as to be low by as much as 0.75V, the distortion of the pixel voltage is removed.

As a result, the pixel voltage distortion amount becomes even in the whole gray level range such that it is possible to display images on the LCD panel without distortion over the whole grayscale range by tuning the common voltage Vcom.

In the same manner, the gamma voltages at the gray levels other than the maximum and minimum gray levels are randomly tuned such that all of the gamma voltages (VGMA1~VGMA10) can be tuned. Here, the gamma voltages are randomly tuned, and all the gamma voltages (corresponding to the number of bits) are tuned. In the above example, the gamma voltage values before and after gamma voltage compensation by the gamma voltage compensation apparatus are shown in Table 1. Also, the gamma voltages before and after gamma voltage compensation by the gamma voltage compensation apparatus are shown relative to the gray levels as a graph in FIG. 7.

In the above explanation, a compensation method is described in which the maximum gray level gamma voltage is tuned to be increased and the minimum gray level gamma voltage is tuned to be decreased in the case of a normally white mode liquid crystal display and the case where the kickback voltage at the maximum gray level (white) is greater than the kickback voltage at the minimum gray level (black). However, the level and direction of the kickback voltage may differ according to the type of the liquid crystal. Accordingly, the adjustment of the gamma voltage refers to adjusting the gamma voltage so as to be increased when the kickback voltage is high and decreased when the kickback voltage is low, and this is performed when adjusting the gamma voltages at the parts where the gray level is greater than and less than the intermediate gray level after tuning so that there is no pixel voltage distortion by tuning the common voltage at the intermediate gray level.

As described above, in the preferred embodiment of the present invention, the gamma voltage generation apparatus tunes the common voltage by as much as the kickback voltage at the intermediate gray level if a predetermined kickback voltage to the present display status is inputted by the user in a predetermined manner. Also, to tune the distorted pixel voltage at gray levels other than the intermediate gray level, the gamma voltages, other than the gamma voltage at the intermediate gray level, are tuned. Here, the adjustment of the gamma voltages, other than the gamma voltage at the intermediate gray level, is achieved in such a manner that the difference between the intermediate gray level kickback voltage and the kickback voltage at one of the gray levels other than the intermediate gray level is equal to half of the difference between the sum of the two inverted gamma voltages representing the intermediate gray level gamma voltages and the sum of the two inverted gamma voltages corresponding to the selected gray level. As a result, the generation of residual images in the displayed image is minimized.

As described above, in the LCD according to the preferred embodiment of the present invention, the residual DC bias caused by the kickback voltage is removed such that the display of images in which residual images are minimally generated may be realized.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display (LCD) for displaying images with a gray voltage generated by a source driver using a gamma voltage supplied from a printed circuit board, the LCD comprising:

gamma voltage generation unit generating a common voltage control signal for adjusting a common voltage by as much as a kickback voltage at an intermediate gray level when a predetermined kickback voltage associated with a presently displayed image is inputted by a user utilizing a predetermined process, randomly selecting a gamma voltage at a gray level other than the intermediate gray level, and adjusting the selected gamma voltage; and a common voltage generator for adjusting the common voltage by as much as the kickback voltage at the intermediate gray level on the basis of the common voltage control signal, and outputting the adjusted common voltage to an LCD panel;

wherein the gamma voltage generation unit satisfies the following equation:

$$|Vkc-Vkt|=|(VGMAUP(C)+VGMADN(C))/2-(VGMAUP(t)+VGMADN(t))/2|$$

where Vkc is a kickback voltage at the intermediate gray level, Vkt is the kickback voltage at the selected gray level, VGMAUP(C) and VGMADN(C) are gamma voltages inverted at the intermediate gray level, and VGMAUP(t) and VGMADN(t) are the gamma voltages inverted at the selected gray level.

2. A method for driving a liquid crystal display (LCD) which displays images with a gray voltage generated by a source driver using a gamma voltage supplied from a gamma voltage generator comprising the steps of:

(a) generating a common voltage control signal for adjusting a common voltage by as much as a kickback voltage at an intermediate gray level when a predetermined kickback voltage associated with a presently displayed image is inputted by a user utilizing a predetermined process; and (b) randomly selecting a gamma voltage at a gray level other than the intermediate gray level, and adjusting the selected gamma voltage;

wherein the gamma voltage generation unit satisfies the following equation:

$$|Vkc-Vkt|=|(VGMAUP(C)+VGMADN(C))/2-(VGMAUP(t)+VGMADN(t))/2|$$

where Vkc is a kickback voltage at the intermediate gray level, Vkt is the kickback voltage at the selected gray level, VGMAUP(C) and VGMADN(C) are gamma voltages inverted at the intermediate gray level, and VGMAUP(t) and VGMADN(t) are the gamma voltages inverted at the selected gray level.

* * * * *